US005842368A

United States Patent [19]

Barten et al.

[11] Patent Number: 5,842,368

[45] Date of Patent: Dec. 1, 1998

[54] MULTIROLL STAND

[75] Inventors: Axel Barten, Siegen; Josef Troster, Olpe; Werner Stahl, Kreuztal, all of Germany

[73] Assignee: Achenbach Buschhutten GmbH, Kreuztal, Germany

[21] Appl. No.: 800,749

[22] Filed: Feb. 14, 1997

[30] Foreign Application Priority Data

Feb. 23, 1996 [DE] Germany ..... 296 03 117.8
May 23, 1996 [DE] Germany ..... 196 20 704.5

[51] Int. Cl.[6] ..... B21B 13/14

[52] U.S. Cl. ..... 72/241.8

[58] Field of Search ..... 72/241.2, 241.8, 72/241.4, 242.2, 245, 247, 248

[56] References Cited

U.S. PATENT DOCUMENTS 3,943,742 3/1976 Kajiwara et al. ..... 72/247
4,499,748 2/1985 Nihei et al. ..... 72/241.8

FOREIGN PATENT DOCUMENTS 0 088 443 9/1986 European Pat. Off. .
1 289 811 7/1973 Germany .
34 37 601 4/1986 Germany .
60-15003 A 1/1985 Japan ..... 72/241.8

*Primary Examiner*—Joseph J. Hail, III
*Assistant Examiner*—Rodney Butler
*Attorney, Agent, or Firm*—Young & Thompson

[57] ABSTRACT

A six-high multi-roll stand (1), has one top and one bottom work roll (2, 3) which are supported in chocks (4, 5), with one top and one bottom intermediate roll (6, 7) which are supported in chocks (8, 9), and with one top and one bottom back-up roll (10, 11) with bearings located in one top and one bottom chock (12, 13). Two functional units are integrated into windows (16) of two roll housings (14, 15) with four each hydraulic operating cylinder units (18, 18, 19, 19) located symmetrically and parallel to roll axis plan 17—17), each operating cylinder unit (18, 19) consisting of top operating cylinder (18*a*, 19*a*) with top actuating piston (20*a*, 21*a*) which acts on chock (12) of top back-up roll (10) and bottom operating cylinder (18*b*, 19*b*) with bottom actuating piston 20*b*, 21*b*) which acts on chock (13) of bottom back-up roll (11) for counterbalancing back-up roll (10), and two operating cylinders (18*a*, 18*b*; 19*a*, 19*b*) of each operating cylinder unit (18, 19) in common cylinder housing (22, 23). Double-acting actuating sleeves (24*a*, 24*b*; 25*a*, 25*b*) cause bending of intermediate rolls (6, 7) and work rolls (2, 3) and engage chocks (8, 9; 4, 5) of intermediate rolls (6, 7) and work rolls (2, 3) by means of projections (26).

9 Claims, 6 Drawing Sheets

MULTIROLL STAND

The invention relates to a multiroll stand, especially a six-high stand, with one top and one bottom back-up roll, and one top and one bottom work roll, and optionally one top and one bottom intermediate roll, a means for counterbalancing the back-up rolls, roll bending means for the work rolls and the intermediate rolls, means for mutual axial displacement of the work and/or intermediate rolls and with means for horizontal parallel displacement of the work rolls or intermediate rolls (EP 88 443 B2).

DE 42 03 189 A1 discloses a four-high stand with operating cylinders for counterbalancing and bending of the work rolls, the operating cylinders being located in retaining blocks which are installed in the windows of the roll housings. This roll stand structure is very complex.

In a four-high stand described in DE 12 89 811 C2 the operating cylinders for counterbalancing and bending of the work rolls are housed in the legs of the back-up roll chocks. This design has the disadvantage that in the mounting and dismounting of a roll stack all hydraulic lines of the operating cylinders must be detached from and connected to the connecting lines in the roll housings.

The object of the invention is to improve the generic multiroll stand with respect to a simplified mounting and dismounting of rolls and simplification of the stand structure which leads to a reduction of production costs.

This object is achieved according to the invention by a multiroll stand with the features of claim 1.

The subclaims contain feasible and advantageous developments of the invention.

Figure 1:
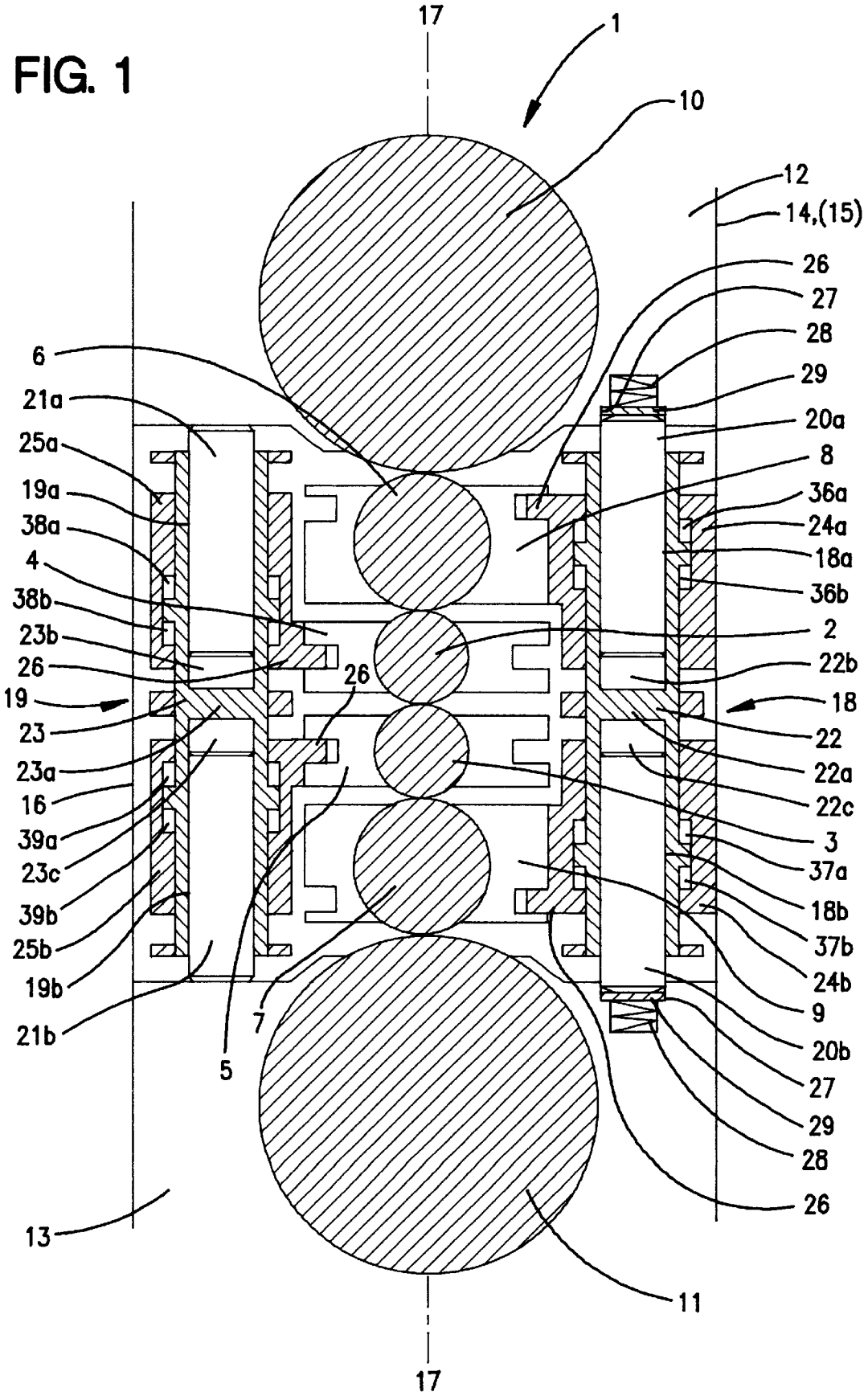
Figure 2:
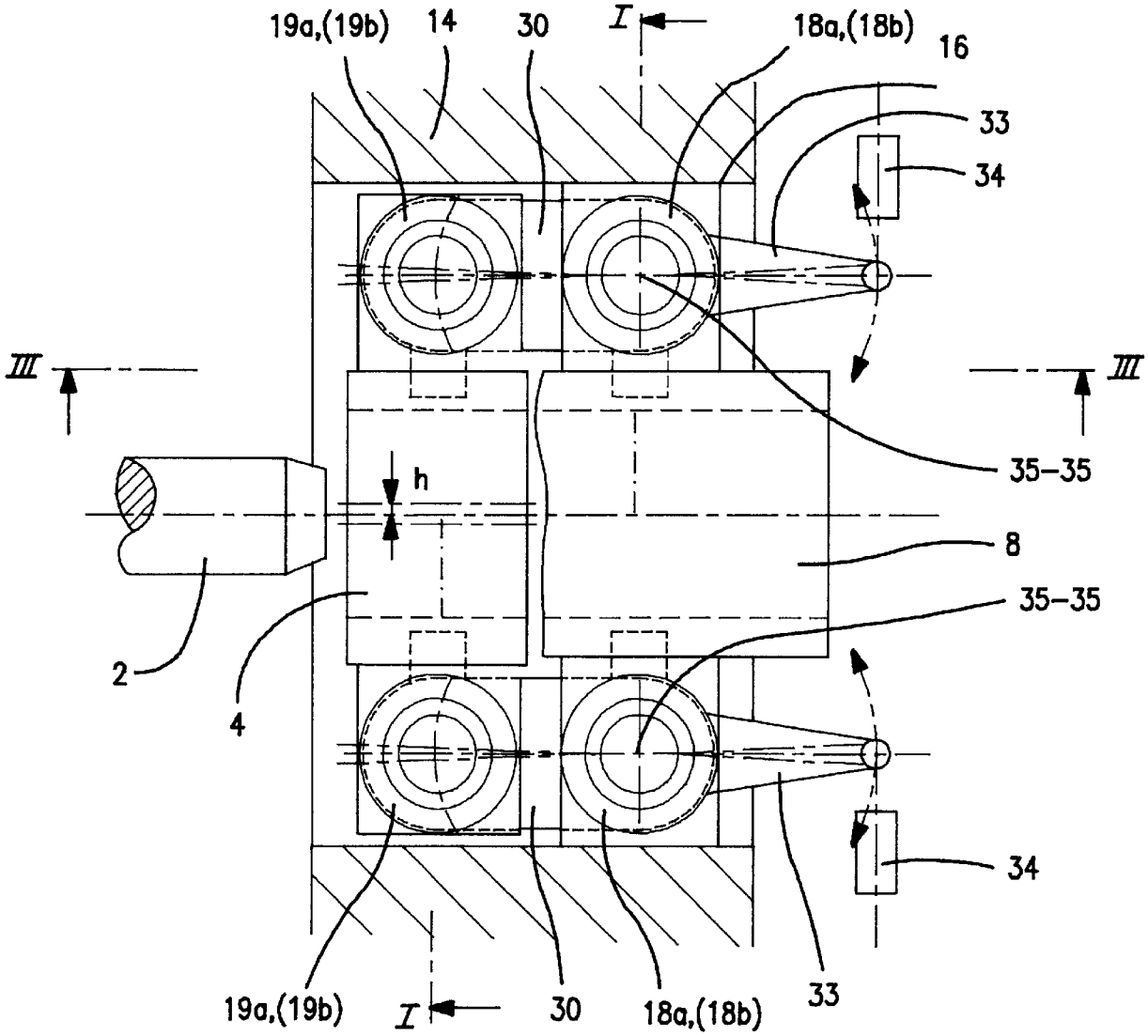
Figure 3:
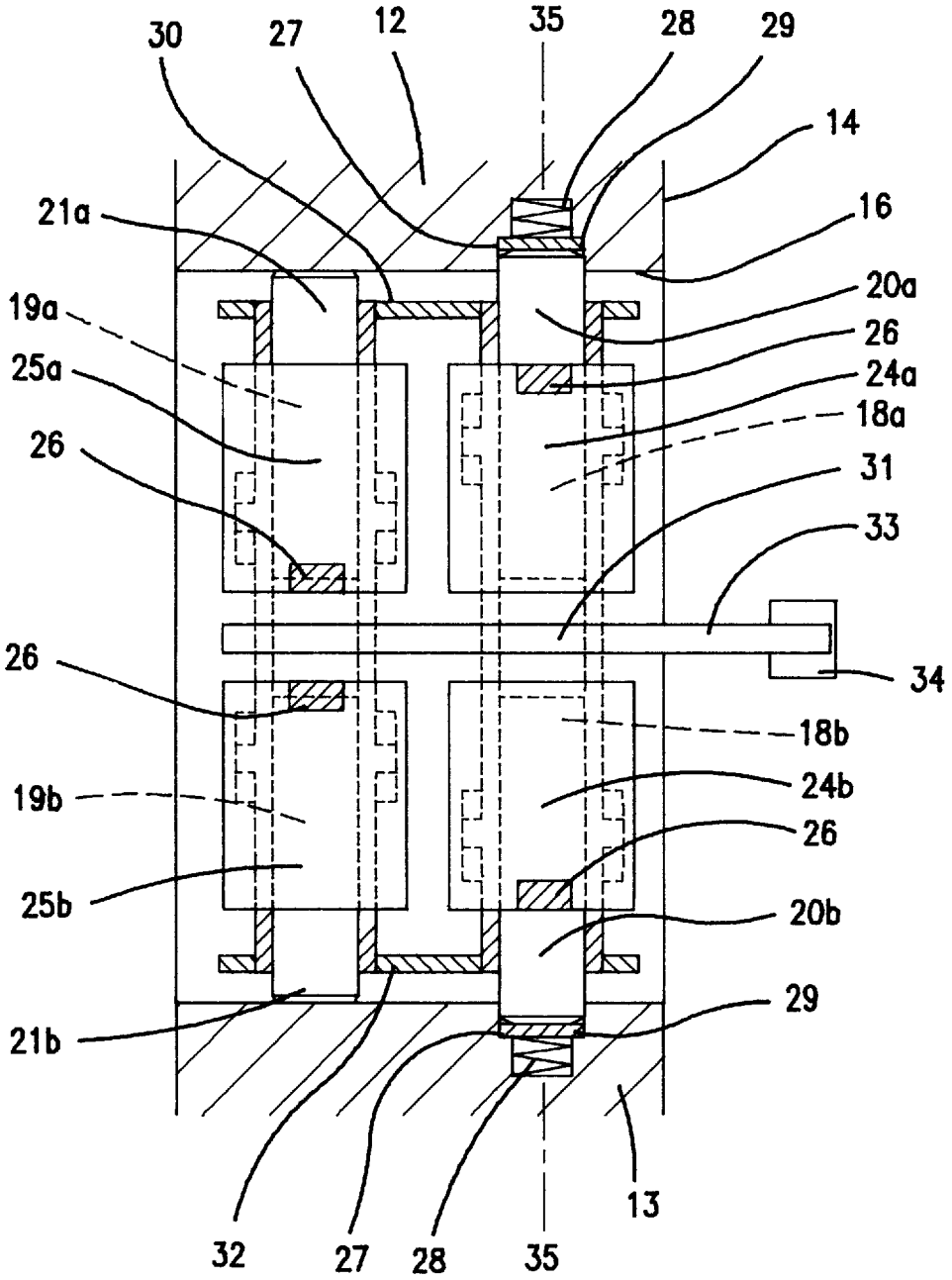
Figure 4:
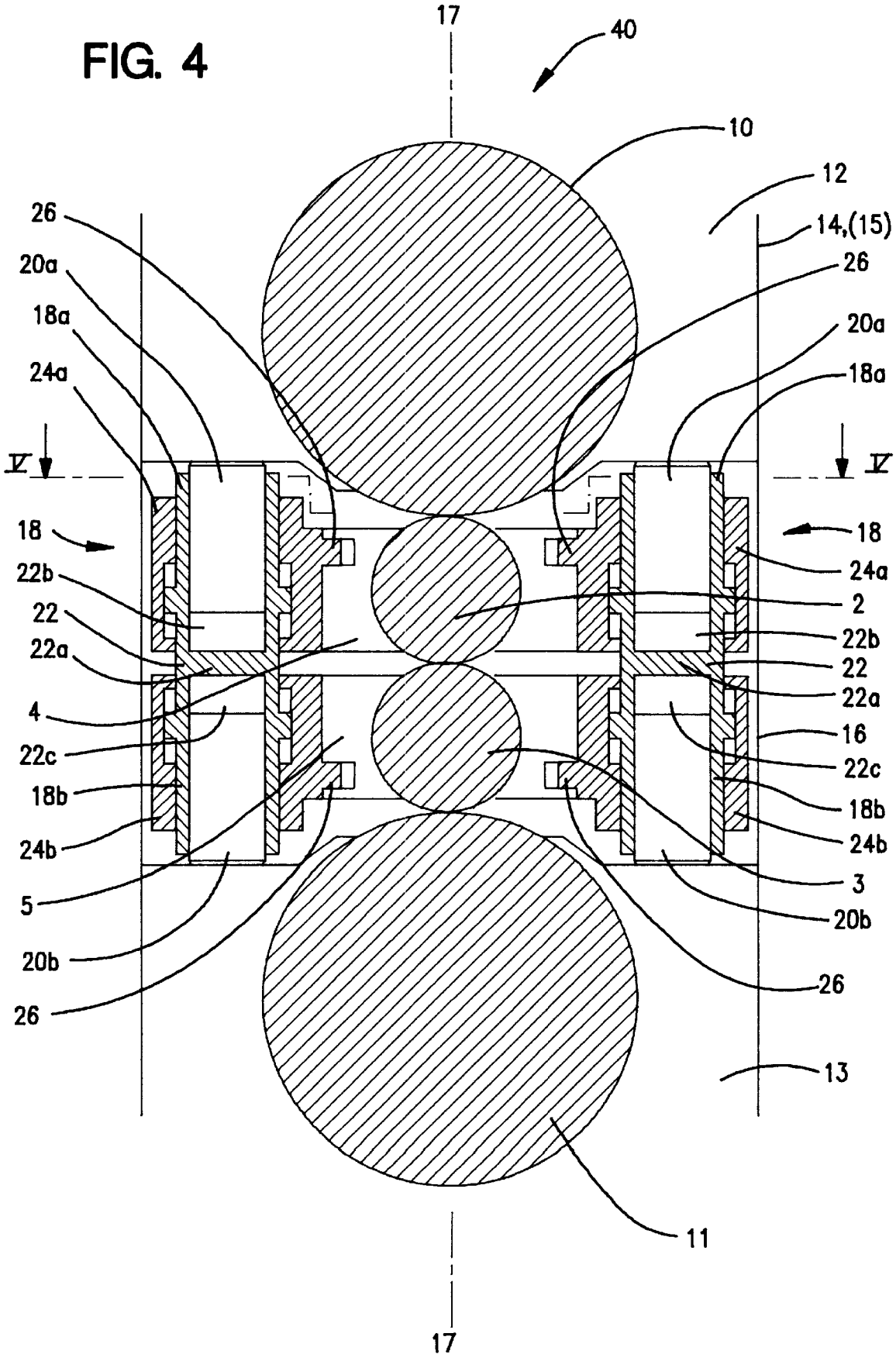
Figure 5:
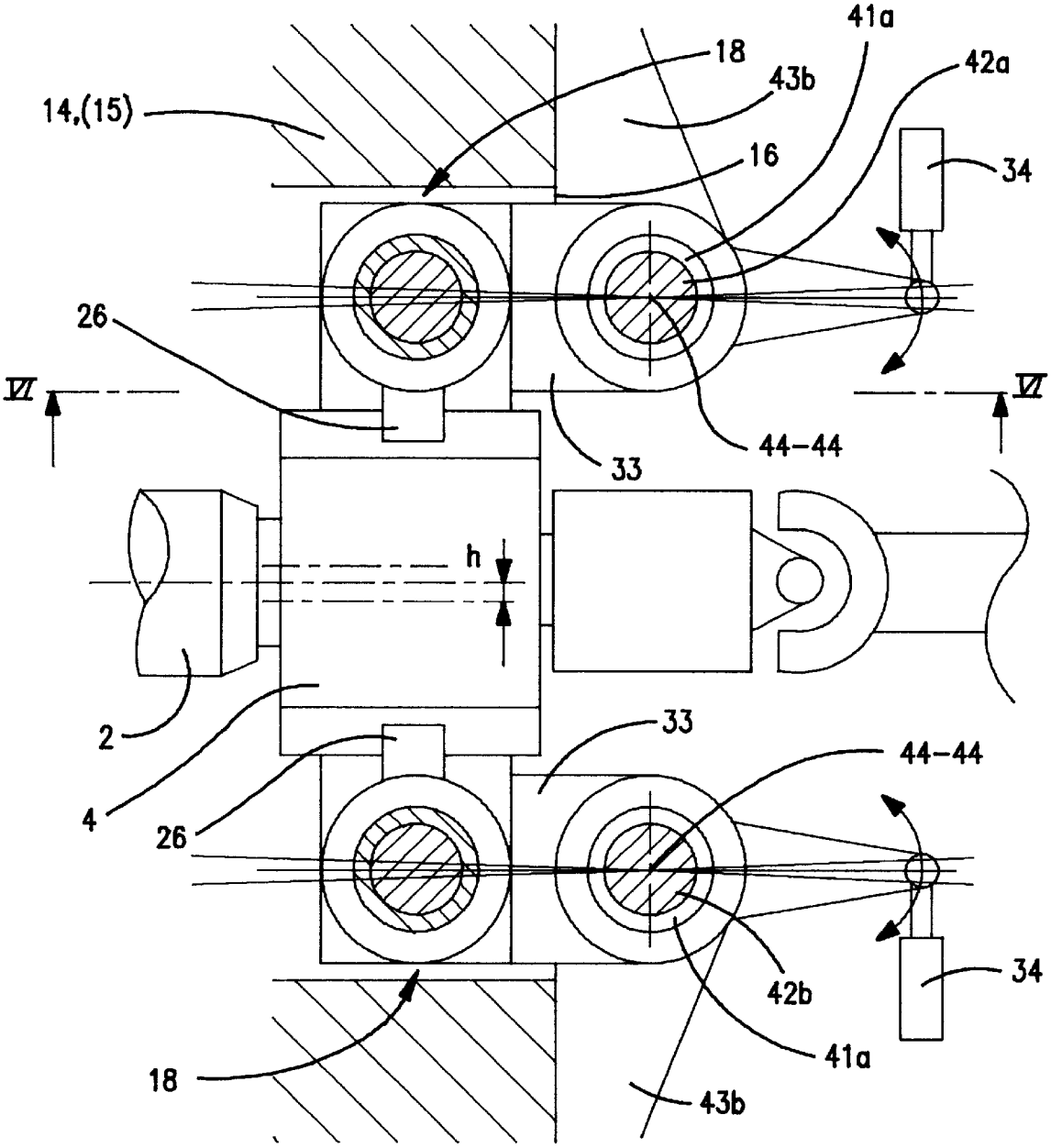
Figure 6:
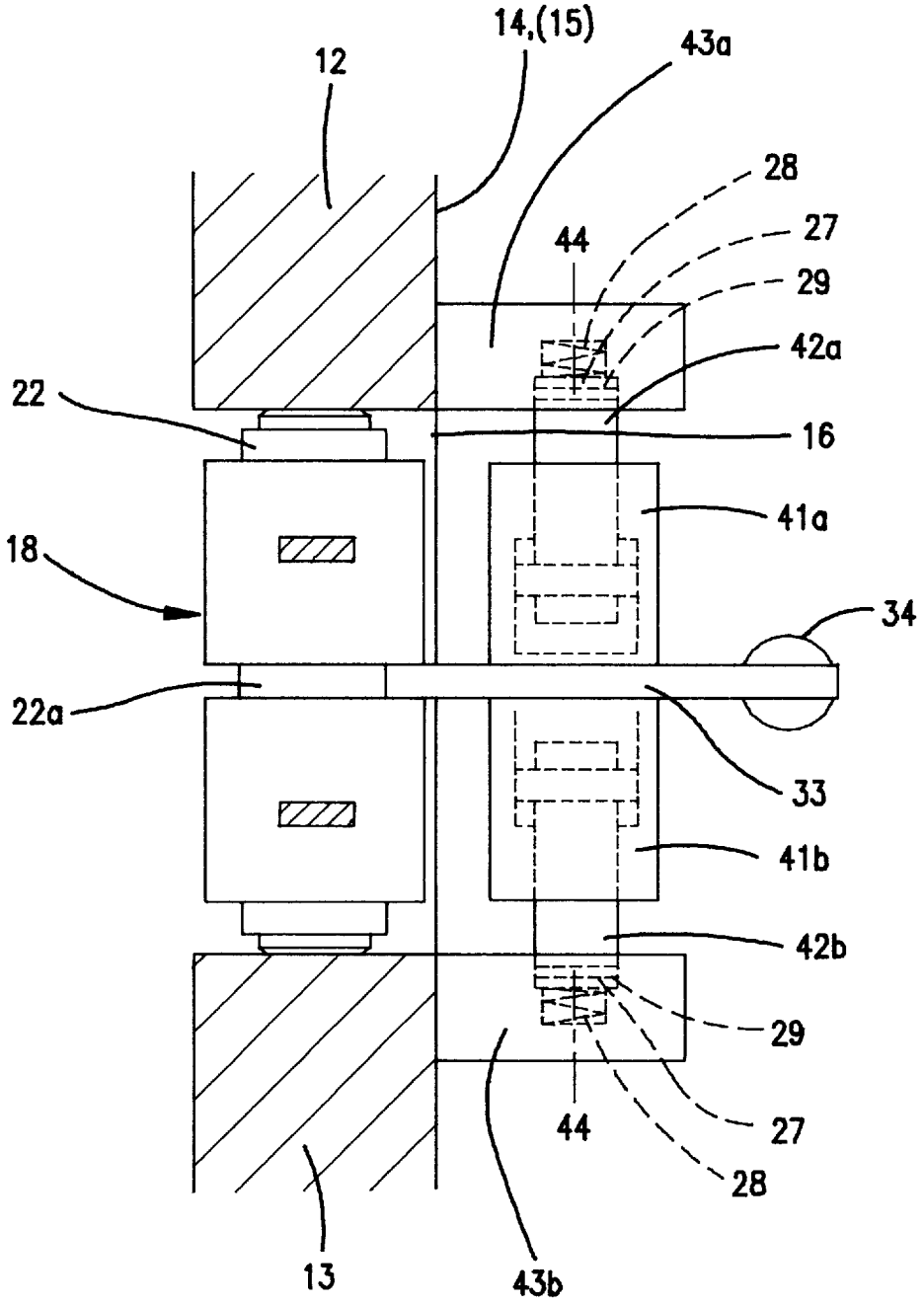

The invention with its advantages over the prior art is explained below using schematic drawing figures of a six-high stand and a four-high stand which in particular explain the following:

FIG. 1 shows a vertical section of a roll housing of a six-high stand according to Line I—I of FIG. 2, FIG. 2 shows an overhead view of a functional unit integrated into the window of a roll housing of the roll stand according to FIG. 1, FIG. 3 shows a section according to line III—III of FIG. 2, FIG. 4 shows a vertical section of a roll housing of a four-high stand, FIG. 5 shows a section according to line V—V of FIG. 4 and FIG. 6 shows a section according to line VI—VI of FIG. 5.

Six-high stand 1 according to FIGS. 1 through 3 is equipped with one top and one bottom work roll 2, 3 which are supported in chocks 4, 5, furthermore with one top and one bottom intermediate roll 6, 7 which are supported in chocks 8, 9, and with one top and one bottom back-up roll 10, 11 with bearings located in one top and one bottom chock 12, 13.

Two functional units with four hydraulic operating cylinder units 18, 18, 19, 19 each located symmetrically and parallel to vertical roll axis plane 17—17 are integrated into windows 16 of two housings 14, 15 of six-high stand 1.

Each operating cylinder unit 18 consists of top operating cylinder 18*a* with top actuating piston 20*a* which acts on chock 12 of top back-up roll 10 and bottom operating cylinder 18*b* with bottom actuating piston 20*b* which acts on chock 13 of bottom back-up roll 11 for counterbalancing back-up roll 10, actuating pistons 20*a*, 20*b* being made as plunger pistons.

Accordingly, each operating cylinder unit 19 consists of top operating cylinder 19*a* with top actuating piston 21*a* which acts on chock 12 of top back-up roll 10, and of bottom operating cylinder 19*b* with actuating piston 21*b* which acts on chock 13 of bottom back-up roll 11 and which is made as a plunger piston just like actuating piston 21*a*.

Operating cylinders 18*a*, 18*b* and 19*a*, 19*b* of operating cylinder units 18, 19 are each installed coaxially in common cylinder housing 22 and 23 which is divided by bottom 22*a* and 23*a* into two cylinder chambers 22*b*, 22*c* and 23*b*, 23*c*.

Four operating cylinder units 18, 19; 18, 19 integrated into each window 16 of two roll housings 14, 15 of six-high stand 1 furthermore include on operating cylinders 18*a*, 18*b* and 19*a*, 19*b* same hydraulically movable, double-acting actuating sleeves 24*a*, 24*b* and 25*a*, 25*b* which cause bending of intermediate rolls 6, 7 and work rolls 2, 3 and which engage chocks 8, 9 of intermediate rolls 6, 7 and chocks 4, 5 of work rolls 2, 3 by means of projections 26.

Actuating sleeves 24*a*, 24*b*, which are each movably supported on operating cylinder units 18 located on the outside of housing windows 16 engage chocks 8, 9 of intermediate rolls 6, 7, and actuating sleeves 25*a*, 25*b* which are each movably supported on operating cylinder units 19 located on the inside of housing windows 16 act on chocks 4, 5 of work rolls 2, 3.

Actuating pistons 20*a*, 20*b* of operating cylinder units 18 which are located on the outside of housing windows 16, the pistons acting on back-up roll chocks 12, 13, on both sides of the housing windows are guided in centering holes 27 in top and bottom back-up roll chock 12, 13, compression springs 28 which are inserted into centering holes 27 of back-up roll chocks 12, 13 acting on operating pistons 20*a*, 20*b* via thrust washers 29.

Four operating cylinders 18*a*, 18*b*; 19*a*; 19*b* of two operating cylinder units 18, 19; 18, 19 located on both sides of housing windows 16 are joined to one another by top frame 30, middle frame 31 and bottom frame 32.

Actuating sleeves 24*a*, 24*b* which are movably supported on operating cylinder units 18 for counterbalancing of back-up rolls 10, 11 for bending of intermediate rolls 10, 11 are made to guide chocks 8, 9 of intermediate rolls 6, 7, and actuating sleeves 25*a*, 25*b* which can be moved on operating cylinder units 19 for counterbalancing of back-up rolls 10, 11 are used to guide chocks 4, 5 of work rolls 2, 3.

Another double-acting hydraulic operating cylinder 34 is coupled to extension 33 of middle frame 31 of two operating cylinder units 18, 19; 18, 19 on the two sides of housing windows 16. When operating cylinders 34 are actuated operating cylinder units 19 with actuating sleeves 25*a*, 25*b* for work roll chocks 4, 5 are swivelled around rotary axes 35—35 which are formed by operating cylinder units 18 with actuating pistons 20*a*, 20*b* which dip into chocks 12, 13 of top and bottom back-up roll 10, 11 and in this way parallel horizontal adjustment h of work rolls 2, 3 with reference to back-up rolls 10, 11 is achieved in or against the direction of rolling.

By applying pressure to operating cylinders 18*a* and optionally 18*b*, a pressure which is greater than the pressure necessary to compensate for the weight of top back-up roll 10 and optionally bottom back-up roll 11, a force opposite the adjusting force can be produced with the objective of being able to control small roll forces with higher precision.

Neither for positive nor negative bending forces generated by actuating sleeves 24*a*, 24*b*; 25*a*, 25*b* are vertical forces introduced into cylinder housing 22, 23, and actuating sleeves 24*a*, 24*b*; 25*a*, 25*b* can be freely adjusted depending on roll abrasion, with communicating pressurization by a hydraulic means, preferably compressed oil.

After capturing the weight of top back-up roll 10 and top back-up roll chock 12 and unloading cylinder chambers 22*b*, 22*c*, 23*b*, 23*c* of operating cylinder units 18, 19, actuating pistons 20*a*, 20*b* are pressed by compression springs 28 into operating cylinders 18*a*, 18*b*, so that the functional units can be removed from windows 16 of roll housings 14, 15 after the hydraulic connections are detached.

By partially blocking pressure chambers 36*a*, 36*b*; 37*a*, 37*b*; 38*a*, 38*b*, and 39*a*, 39*b* of actuating sleeves 24*a*, 24*b*; 25*a*, 25*b* for bending of intermediate rolls 6, 7 and work rolls 2, 3 and partially blocking cylinder chambers 22*b*, 22*c*; 23*b*, 23*c* of operating cylinders 18*a*, 18*b*; 19*a*, 19*b* for counterbalancing of back-up rolls 10, 11 coupled with controlled triggering of the non-blocked pressure and cylinder chambers, dismounting of each individual work roll 2, 3 and each individual intermediate roll 6, 7 is enabled.

The above described functional units can also be used with the corresponding structural changes in four-high stands as is explained below.

Four-high stand 40 which is shown in FIGS. 4 through 6 is made with one top and one bottom work roll 2, 3 which are supported in chocks 4, 5, and with one top and one bottom back-up roll 10, 11 with bearings located in one top and one bottom chock 12, 13.

Two functional units with two hydraulic operating cylinder units 18, 18 which are located symmetrically and parallel to vertical roll axis plane 17—17 are integrated into windows 16 of two housings 14, 15 of four-high stand 40.

Each operating cylinder unit 18 consists of one top operating cylinder 18*a* with one top actuating piston 20*a* which acts on chock 12 of top back-up roll 10 and bottom operating cylinder 18*b* with one bottom actuating piston 20*b* which acts on chock 13 of bottom back-up roll 11 for counterbalancing of back-up roll 10.

Operating cylinders 18*a*, 18*b* of operating cylinder units 18 are each installed in common cylinder housing 22 which is divided by bottom 22*a* into two cylinder chambers 22*b*, 22*c*.

Four operating cylinder units 18 integrated into windows 16 of two roll housings 14, 15 of four-high stand 40 furthermore include on operating cylinders 18*a*, 18*b* the same hydraulically movable, double-acting actuating sleeves 24*a*, 24*b* which cause bending of work rolls 2, 3 and which engage chocks 4, 5 of work rolls 2, 3 by means of projections 26.

On extension 33 of bottom 22*a* of cylinder housing 22 of two operating cylinder units 18, 18 of each roll housing 14, 15 which is each pointed to the outside parallel to roll axle plane 17—17 of roll stand 40 from housing window 16, there are attached two double-acting holding cylinders 41*a*, 41*b* located coaxially and parallel to operating cylinder units 18 with locking pistons 42*a*, 42*b* which are made as plunger pistons and which each dip into top and bottom bracket 43*a*, 43*b* provided with corresponding centering hole 27, which are attached on the outside of housing window 16 to two roll housings 14, 15 of four-high stand 40, compression springs 28 inserted into centering holes 27 in brackets 43*a*, 43*b* acting on locking pistons 42*a*, 42*b* via thrust washers 29. One additional, double-acting hydraulic operating cylinder 34 each is attached to extension 33 of operating cylinder units 18.

When operating cylinders 34 are actuated operating cylinder units 18 with actuating pistons 20*a*, 20*b* for counterbalancing of back-up rolls 10, 11 and with actuating sleeves 24*a*, 24*b* for bending of work rolls 2, 3 are swivelled around rotary axes 44—44 which are formed by holding cylinders 41*a*, 41*b* with locking pistons 42*a*, 42*b* which dip into brackets 43*a*, 43*b* on roll housings 14, 15 and in this way parallel horizontal adjustment h of work rolls 2, 3 with reference to back-up rolls 10, 11 is achieved in or against the direction of rolling (FIGS. 5 and 6).

We claim:

1. In a multiroll stand, especially a six-high stand, with one top and one bottom back-up roll, one top and one bottom work roll, a means for counterbalancing the back-up rolls, roll bending means for the work rolls, means for mutual axial displacement of the work rolls and with means for horizontal parallel displacement of the work rolls; the improvement comprising two functional units integrated into windows (16) of two roll housings (14, 15) of the roll stand (1) with four each hydraulic operating cylinder units (18, 19) located symmetrically and parallel to a roll axis plane (17—17), each operating cylinder unit (18, 19) consisting of top operating cylinder (18*a*, 19*a*) with a top actuating piston (20*a*, 21*a*) which acts on a chock (12) of said top back-up roll (10) and a bottom operating cylinder (18*b*, 19*b*) with a bottom actuating piston (20*b*, 21*b*) which acts on a chock (13) of said bottom back-up roll (11) for counterbalancing said back-up roll (10), and two operating cylinders (18*a*, 18*b*; 19*a*, 19*b*) of each operating cylinder unit (18, 19) being installed coaxially into a common cylinder housing (22, 23) which is divided by a bottom (22*a*, 23*a*) into two cylinder chambers (22*b*, 22*c*; 23*b*, 23*c*), and on operating cylinders (18*a*, 18*b*; 19*a*, 19*b*) of said operating cylinder units (18, 19) hydraulically movable, double-acting actuating sleeves (24*a*, 24*b*; 25*a*, 25*b*) which cause bending of said work rolls (2, 3) and which engage chocks (8, 9; 4, 5) of said work rolls (2, 3) by means of projections (26).

2. Roll stand according to claim 1, wherein actuating sleeves (25*a*, 25*b*) which can move on operating cylinder units (19) engage chocks (4, 5) of said work rolls (2, 3).

3. Roll stand according to claim 1, wherein actuating pistons (20*a*, 20*b*) of outside operating cylinder units (18), the pistons dipping into back-up roll chocks (12, 13), by compression springs (28) which are inserted into back-up roll chocks (12, 13) cause reset of actuating pistons (20*a*, 20*b*) via thrust washers (29).

4. Roll stand according to claim 1, wherein actuating pistons (20*a*, 20*b*; 21*a*, 21*b*) of said operating cylinders (18*a*, 18*b*; 19*a*; 19*b*) are made as plunger pistons.

5. Roll stand according to claim 1, wherein four operating cylinders (18*a*, 18*b*; 19*a*, 19*b*) of two operating cylinder units (18, 19; 18, 19) located on opposite sides of housing windows (16) are interconnected by frames (30, 31, 32).

6. Roll stand according to claim 1, wherein actuating sleeves (25*a*, 25*b*), which are movably supported on operating cylinder units (19) for counterbalancing of said back-up rolls (10, 11) for bending of said work rolls (2, 3) are made to guide chocks (4, 5) of said work rolls (2, 3).

7. Roll stand according to claim 1, further comprising operating cylinders (34) which engage an extension (33) of a middle frame (31) of two operating cylinder units (18, 19; 18, 19) on opposite housing window sides for parallel horizontal adjustment (h) of said work rolls (2, 3) with reference to said back-up rolls (10, 11) in or against the direction of rolling by swivelling around a rotary axis (35—35) operating cylinder units (19) with actuating sleeves (25*a*, 25*b*) for work roll chocks (4, 5) which are formed by operating cylinder units (18) with actuating pistons (20*a*, 20*b*) which dip into chocks (12, 13) of said top and bottom back-up rolls (10, 11).

8. In a four-high stand, with one top and one bottom work roll and with one top and one bottom back-up roll, means for counterbalancing of back-up rolls, bending means for work rolls and with means for horizontal parallel displacement of work rolls; the improvement comprising two functional units integrated into windows (16) of two roll housings (14, 15) of said roll stand (40), with two each operating cylinder units (18, 18), each operating cylinder unit (18) consisting of one top operating cylinder (18*a*) with a top actuating piston (20*a*) which acts on a chock (12) of said top back-up roll (10), and a bottom operating cylinder (18*b*) with a bottom actuating piston (20*b*) which acts on a chock (13) of said bottom back-up roll (11) for counterbalancing of said back-up roll (10), the two operating cylinders (18*a*, 18*b*) of each operating cylinder unit (13) being installed coaxially in a common cylinder housing (22) which is divided by a bottom (22*a*) into two cylinder chambers (22*b*, 22*c*), and on operating cylinders (18*a*, 18*b*) of cylinder units (18) hydraulically movable double-acting actuating sleeves (24*a*, 24*b*) which cause bending of said work rolls (2, 3) b y engaging chocks (4, 5) of said work rolls (2, 3) by means of projections (26).

9. Four-high stand according to claim 8, further comprising an extension (33) of said bottom (22*a*) of said cylinder housing (22) of two operating cylinder units (18, 18) of each roll housing (14, 15) which is each pointed outwardly parallel to a roll axis plane (17—17) of said roll stand (40) from a said housing window (16), two double-acting holding cylinders (41*a*, 41*b*) located on said extension (33) of said cylinder housing (22) coaxially and parallel to operating cylinder units (18) with locking pistons (42*a*, 42*b*) which are made as plunger pistons, and operating cylinders (34) which engage said extension (33) of said operating cylinder units (18) for parallel horizontal adjustment (h) of said work rolls (2, 3) with reference to said back-up rolls (10, 11) in or against the direction of rolling by swivelling said operating cylinder units (18) for work roll and back-up roll chocks (4, 5; 12, 13) around rotary axes (44—44) which are formed by holding cylinders (41*a*, 41*b*) with locking pistons (42*a*, 42*b*) which dip each into top and bottom brackets (43*a*, 43*b*) which are provided with a corresponding centering hole (27) and springs (28) and thrust washers (29) and which are attached outside of housing windows (16) to two roll housings (14, 15) of said roll stand (40).

* * * * *